US007335093B1

(12) United States Patent
Stanley

(10) Patent No.: US 7,335,093 B1
(45) Date of Patent: Feb. 26, 2008

(54) BLADE SHARPENING HOLDER

(76) Inventor: Harrelson Stanley, 51 Shattuck St., Pepperell, MA (US) 01463

( * ) Notice: Subject to any disclaimer, the term of this patent is extended or adjusted under 35 U.S.C. 154(b) by 0 days.

(21) Appl. No.: 11/530,988

(22) Filed: Sep. 12, 2006

(51) Int. Cl.
*B24B 19/00* (2006.01)

(52) U.S. Cl. ..... 451/367; 451/45; 451/170; 451/365; 451/370; 451/371

(58) Field of Classification Search ..... 451/45, 451/170, 365, 367, 370, 371
See application file for complete search history.

(56) References Cited

U.S. PATENT DOCUMENTS

| | | | | |
|---|---|---|---|---|
| 103,739 | A * | 5/1870 | Hanks | 451/370 |
| 1,239,494 | A * | 9/1917 | Lange | 451/370 |
| 3,654,823 | A | 4/1972 | Juranitch | |
| 3,800,632 | A | 4/1974 | Juranitch | |
| 3,950,899 | A * | 4/1976 | Gilbert | 451/370 |
| 4,070,929 | A | 1/1978 | Risher | |
| 4,512,111 | A | 4/1985 | Childers | |
| 4,512,112 | A | 4/1985 | LeVine | |
| 4,733,501 | A | 3/1988 | McLean | |
| 4,736,544 | A | 4/1988 | Greenquist | |
| 5,195,275 | A | 3/1993 | McLean | |
| 5,431,068 | A | 7/1995 | Alsch | |
| 5,462,476 | A | 10/1995 | Bohn | |
| 5,472,375 | A | 12/1995 | Pugh | |
| 5,527,208 | A | 6/1996 | Blake et al. | |
| 6,030,281 | A | 2/2000 | Cozzini et al. | |
| 6,146,257 | A | 11/2000 | Himeno et al. | |
| 6,168,509 | B1 | 1/2001 | Presgrove | |
| 6,942,551 | B2 | 9/2005 | Mizek et al. | |

* cited by examiner

*Primary Examiner*—Joseph J. Hail, III
*Assistant Examiner*—Shantese McDonald
(74) *Attorney, Agent, or Firm*—Robert R. Deleault, Esq.; Mesmer & Deleault, PLLC

(57) ABSTRACT

A sharpening holder for manually-sharpening a cutting edge to be honed over a honing surface includes a body, an adjustable clamping component, and a plurality of roller members. The body has a first end, a second end and a tool support surface between the first end and the second end. The adjustable clamping component has a fastening plate positioned against the tool support surface. The fastening plate has a tool engaging surface to hold the tool against the tool support surface. The plurality of roller members are attached to a lower portion of the body adjacent the second end where the plurality of roller members are configured to allow the body to roll in a direction selected from the group consisting of sideways and in an arc on the honing surface causing the cutting edge of the tool to move parallel to the honing surface instead of perpendicular to the honing surface.

19 Claims, 5 Drawing Sheets

BLADE SHARPENING HOLDER

BACKGROUND OF THE INVENTION

1. Field of the Invention

The present invention relates generally to tool holders. Particularly, the present invention relates to blade sharpening holders. More particularly, the present invention relates to honing guides and tool grinding rests.

2. Description of the Prior Art

When sharpening a cutting edge on a tool, it was common to use jigs to hold the tool to be sharpened at a predetermined angle to a grind stone. Typically, the grind stones were water cooled. The grinding jigs usually included a roller which supported a plate upon which the tool was secured. The support plate and roller held the tool at a selected angle against the stone surface. As the stone was moved, the cutting edge was ground to the selected angle. The initial setting of the tool in the jig was critical to the success of the operation.

The present use of such guides is now customarily limited to flat bench stones. The skilled artisan, however, differentiates between grinding and honing. Grinding is considered as defining the basic edge and honing as refining the basic edge to the finished sharp edge. In the normal sharpening process, the edge to be sharpened is initially passed over the coarse stone at a selected angle. This process leaves a ragged edge of the desired angle. The bevel is then refined over a stone of finer particles. Since such stones cut more slowly, the work is done on the part of the bevel which intersects with the face of the tool to provide a micro-bevel.

The micro-bevel selected should be a function of the tool material, the material to be cut and the intended use. Ideally, the bevel angle should be no greater than is necessary to prevent the edge from breaking down so that the wedging action of the tool is minimized as the edge enters the material to be cut.

When manually sharpening a tool's cutting edge, the skilled artisan uses a honing stone that is typically rectangular shaped. A small amount of honing oil, which is a lightweight oil, is usually placed on the honing stone. The skilled artisan then pulls or pushes the cutting edge over the honing stone at the desired angle as if the cutting edge were scrapping the surface of the honing stone, i.e. the cutting edge is pushed or pulled over the honing surface in a perpendicular fashion. Several blade holders to facilitate manual sharpening of a cutting edge over a honing surface have been devised.

U.S. Pat. No. 4,733,501 (1988, McLean) discloses a honing guide. The honing guide includes a tool support plate mounted above a surface-engaging roller. The surface engaging roller is mounted eccentrically so that the height of the tool support plate may be varied to provide a range of honing angles without unclamping the tool from the guide.

U.S. Pat. No. 5,472,375 (1995, Pugh) discloses a blade sharpening angle guide. The blade sharpening guide includes an elongated curved block having a longitudinal slot therethrough. The longitudinal slot releasably holds a knife blade with the blade cutting edge extending a distance outside the slot.

U.S. Pat. No. 6,030,281 (2000, Cozzini et al.) discloses a sharpening apparatus. The sharpening apparatus includes a base member on which a sharpening stone is positioned. A slidable blade guide member is slidably connected to the base member and includes a guide surface that is disposed at an angle relative to the upper surface of the sharpening stone and a mounting mechanism for removably mounting a spatula against the guide surface such that the scraping edge of the spatula is in engagement with the sharpening stone. The slidable blade guide member is manually slidable back and forth to sharpen the scraping edge of the spatula. A fixed blade guide member is also attached to the base member. The fixed blade guide member includes a horizontal slot that is adapted to receive the shaft of a grill scraper. The fixed blade guide member is adapted to provide guided back and forth sliding movement of the grill scraper within the slot and engagement with the sharpening member to sharpen the scraping edge of the grill scraper.

The above-described devices require the cutting edge of the tool to move over and against the sharpening/honing stone in a "scraping" motion. In other words, the motion of the cutting edge to the stone surface is similar to the action used with a scraper/tool. A disadvantage of this type of action is that the honing stone surface develops a concave shape with use thus shortening the useful life of the honing stone. Another disadvantage is that the concave surface of the honing stone produces a cutting edge that is inconsistent since the cutting edge angle changes as the cutting edge moves through the concavity in the stone surface. Yet another disadvantage is that only a portion of the honing stone is used since the holder must be on the stone at the beginning of the honing process in order to insure that the cutting edge is positioned correctly relative to the honing surface.

Therefore, what is needed is a sharpening holder for use in manually sharpening a cutting edge that does not cause the development of a concave surface in the honing stone with extended use. What is further needed is a sharpening holder that allows the use of substantially the entire surface area of the honing stone. What is also needed is a sharpening holder that does not use a "scrapping" action of the cutting edge over the honing surface in order to sharpen the cutting edge.

SUMMARY OF THE INVENTION

It is an object of the present invention to provide a sharpening holder that allows a user to use substantially the entire surface area of the honing stone surface when manually honing a cutting edge. It is another object of the present invention to provide a sharpening holder that does not cause the development of a concave honing surface in a honing stone when a cutting edge is sharpened using the sharpening holder. It is a further object of the present invention to provide a sharpening holder that does not rely on "scrapping" the cutting edge into the honing surface to achieve sharpening of the cutting edge.

The present invention achieves these and other objectives by providing a sharpening holder that has a body, an adjustable clamping component, and a plurality of roller members. The body has a first end, a second end and an opening through the body between the first end and the second end, and the opening has a tool support surface. The adjustable clamping component has a fastening plate positioned within the opening of the body. The fastening plate has a tool engaging surface to hold the tool to be sharpened against the tool support surface of the body. The plurality of roller members are attached to a lower portion of the body below the opening and adjacent the second end where the plurality of roller members are configured to allow the body to roll sideways on the honing surface causing the cutting edge to move parallel to the honing surface instead of perpendicular to the honing surface. More specifically, the axis of rotation of the plurality of roller members is perpendicular to the longitudinal axis of the cutting edge to be sharpened. The plurality of roller members may also be configured to allow the body to roll through an arc on the honing surface to provide "parallel" like sharpening of a curved cutting edge.

The adjustable clamping component also includes an adjustable fastener for holding the fastening plate against the tool/blade inserted in the opening of the body. The plurality of roller members is attached to a lower portion of the body below the opening and adjacent the second end of the body. The plurality of roller members may be permanently attached or, preferably, removably attached. Optionally, a raceway may be used to house the plurality of roller members. The raceway is preferably formed at a angle to the bottom of the body and may be incorporated into a body extension that extends below the body adjacent the second end. It should be noted that the use of a raceway is optional, especially when wheels or cylindrical rollers or tapered rollers are used since these could be attached to an angled surface on the bottom of the body or at the second end of the body. If a body extension is used, the body extension may be integrally formed with the body or may be a separate component that is attached to the body.

The unique feature of the present invention is the ability to sharpen the cutting edge of a blade or tool using a sideways motion with the sharpening holder that is parallel to the cutting edge of the blade or tool when manually sharpening a tool on a stationary honing stone surface. The prior art devices require a sharpening motion that is perpendicular to the cutting edge. The parallel sharpening motion has the added advantage that it does not create a concavity in the honing stone surface with use over time like that created by prior art devices.

Another feature of the present invention is the relationship of the cutting edge of a tool/blade mounted in the body to the plurality of roller members. The plurality of roller members is positioned preferably at a predetermined angle to the bottom of the body so that the distance between the cutting edge to be sharpened and the points of contact of the roller members with the honing stone surface is less than one-half the width of the honing stone. This feature provides another advantage of the present invention in that it allows sharpening over substantially the entire honing stone surface.

DETAILED DESCRIPTION OF THE PREFERRED EMBODIMENT

Figure 1:
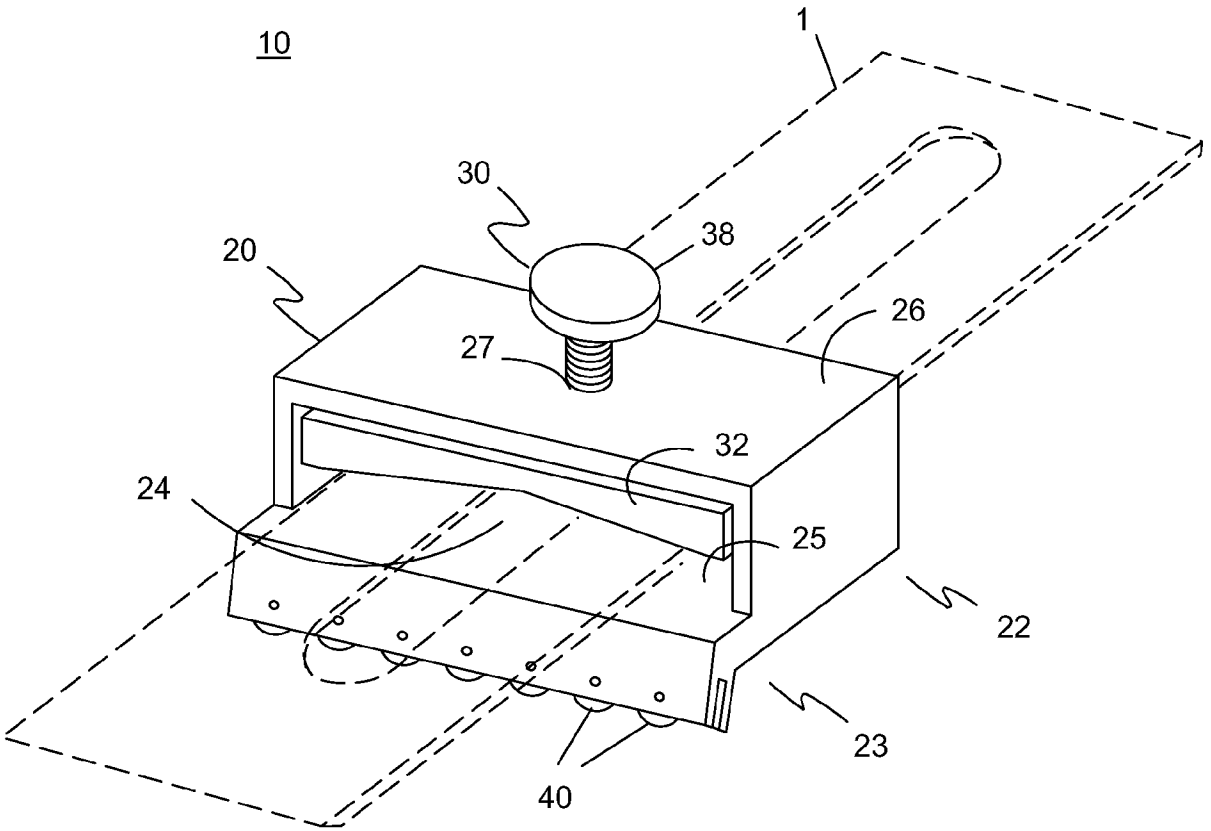
FIG. 1 is a perspective view of the present invention.

The preferred embodiment(s) of the present invention is illustrated in FIGS. 1-8. FIG. 1 shows the sharpening holder 10 of the present invention with one type of blade 1 mounted for sharpening. Sharpening holder 10 has a body 20, an adjustable clamping component 30, and a plurality of roller members 40. Body 20 has a first end 22, a second end 23 and an opening 24 through body 20 between first end 22 and second end 23. Body 20 also includes a tool support surface 25 within opening 24.

Adjustable clamping component 30 includes a fastening plate 32 and an adjustable fastener 38. Adjustable fastener 38 engages fastening plate 32 and imparts a holding force so that fastening plate 32 secures the cutting blade 1 to the tool support surface 25. Although various adjustable fasteners may be used to engage fastening plate 32, adjustable fastener 38 is preferably a thumb screw that engages fastening plate 32 through a threaded opening 27 in a top surface 26 of body 20.

The plurality of roller members 40 are connected to a lower portion 28 of body 20 below opening 24 and adjacent to second end 23. Each of the plurality of roller members 40 are freely rotatable and are aligned to provide body 20 with a sideways rolling action. Roller members 40 that are usable in sharpening holder 10 include wheels, ball bearings, cylindrical rollers, tapered rollers, and the like. An important feature of the plurality of roller members 40 is that the roller members 40 must be sufficiently exposed to allow body 20 to not only roll sideways but also to allow body 20 to pivot through a selected angular range with the pivot point being the points of contact of the roller members 40 with a honing surface of a honing stone (not shown). It should be understood that second end 23 of body 20 may extend to up to and beyond roller members 40 a reasonable distance, if desired, without affecting the functionality of the present invention.

Figure 2:
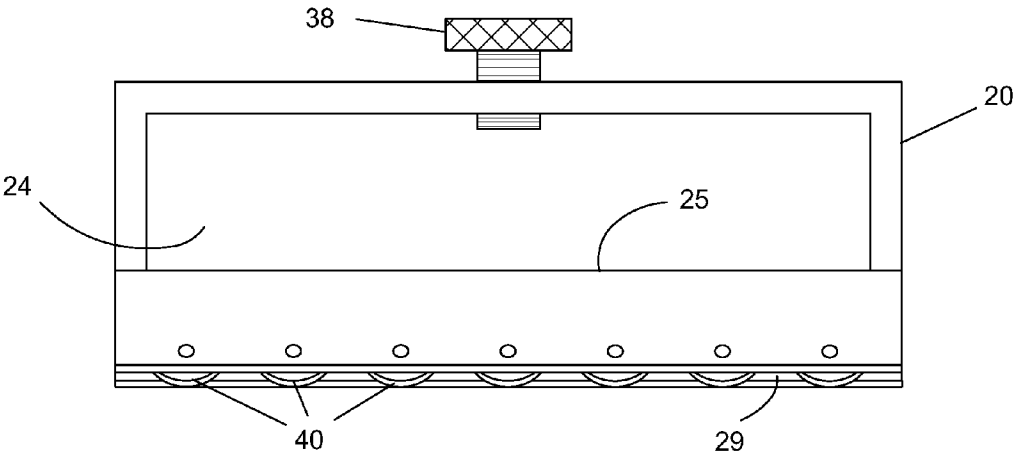
FIG. 2 is a front view of the present invention showing the blade receiving opening in the body of the sharpening holder with the plurality of roller members.

Turning now to FIG. 2, there is illustrated a front view of the present invention. Opening 24 of body 20 and fastening plate 32 may be sized to accommodate a variety of blades and tools having a cutting edge. The plurality of roller members 40 are positioned within a raceway 29 that extends along the width of body 20. The number of roller members 40 connected to body 20 depends on the size of the roller members 40 and the size of body 20, which, in turn, is dependent on the type and size of the blade or tool with a cutting edge that is going to be sharpened and the size of the honing stone surface. The width of body 20 should be shorter than the sharpening surface to allow sufficient sideways sharpening motion. The number of roller elements 40 used is chosen to provide stability to body 20 when it is engaged with the sharpening surface in the sideways sharpening motion. In the preferred embodiment, wheels are the roller members of choice.

Figure 3:
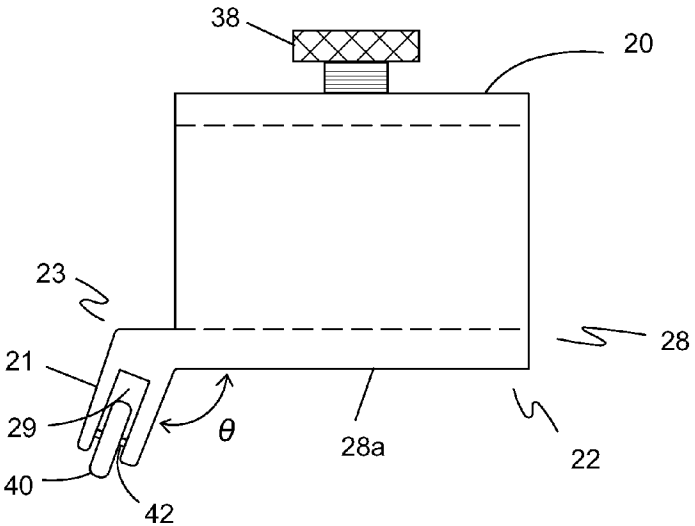
FIG. 3 is a side view of the present invention showing the body and roller members.

FIG. 3 shows a side view of sharpening holder 10. As can be seen, the preferred embodiment has body 20 with a body extension 21 that extends from lower portion 28 below opening 24 adjacent second body end 23. Raceway 29 is located in body extension 21. Each roller member 40 is supported by an axle 42 and all roller members 40 protrude out of raceway 29 a predefined distance. Body extension 21 is structured to have a preset angle θ relative to the bottom 28*a* of body 20. Angle θ is preferably in the range of about 105° to about 125°. Even though body extension 21 is shown as being integral to body 20, body extension 21 may be a separate component that is attached to body 20.

It is important to note that body 20 does not require the use of body extension 21. Raceway 29 could easily be formed into bottom 28*a* adjacent second end 23 at the preset angle θ. The only difference is that body 20 would be slightly heavier due to a thicker bottom portion 28 in order to accommodate raceway 29.

Figure 4:
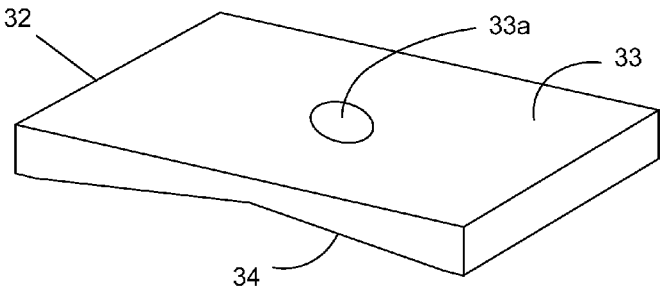
FIG. 4 is a perspective view of the present invention showing the fastening plate of the adjustable clamp component.

Turning now to FIG. 4, there is illustrated a perspective view of fastening plate 32. Fastening plate 32 is sized to fit within opening 24 with the blade/tool to be sharpened. Fastening plate has a top plate surface 33 and a bottom plate surface 34. Top plate surface 33 is engaged by adjustable fastener 38 while bottom plate surface 34 is the tool engaging surface to secure the blade or tool within the sharpening holder 10.

Figure 5:
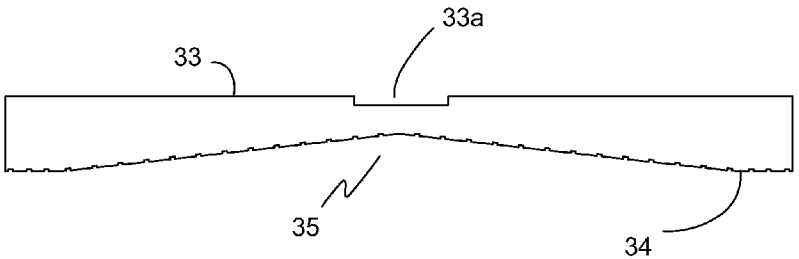
FIG. 5 is a side view of the present invention showing the fastening plate and the concave tool-engaging surface.

FIG. 5 is a side view of fastening plate 32 shown in FIG. 4. Top plate surface 33 includes an optional fastener recess 33*a* for receiving the engaging end of adjustable fastener 38. Optional fastener recess 33*a* prevents fastening plate 32 from inadvertently sliding while engaged by adjustable fastener 38, especially when a blade/tool is being sharpened. Bottom plate surface 34 also includes an optional tool engaging recess 35, which is preferably a V-shaped recess formed in bottom plate surface 34. Similar in purpose to optional fastener recess 33*a*, tool engaging recess 35 prevents the blade/tool from slipping sideways when the sharpening is being performed. Bottom plate surface 34 may also include a plurality of optional bottom plate grooves 34*a*, which are more clearly shown in FIG. 6.

Figure 6:
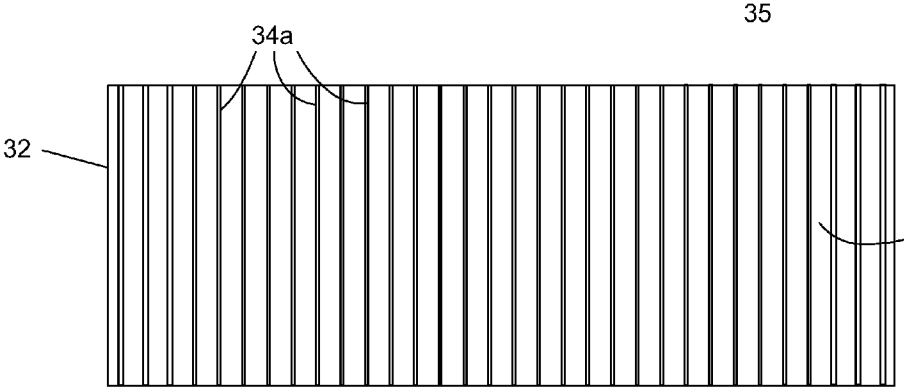
FIG. 6 is a bottom view of the fastening plate of the present invention showing the plurality of tool-holding grooves in the tool-engaging surface.

Turning now to FIG. 6, there is shown a bottom view of fastener plate 32. Bottom plate surface 34 has a plurality of optional bottom plate grooves 34*a*, which are preferably formed in bottom plate surface 34. Optional bottom plate grooves 34*a* also enhance the holding capability of fastener plate 32. The edges of the blade/tool to be sharpened preferably rest within the bottom plate grooves 34*a*, which further restricts any sideways movement of the blade/tool being sharpened. It has been found that the preferred spacing of optional bottom plate grooves 34*a* is 1/32 in.

Figure 7:
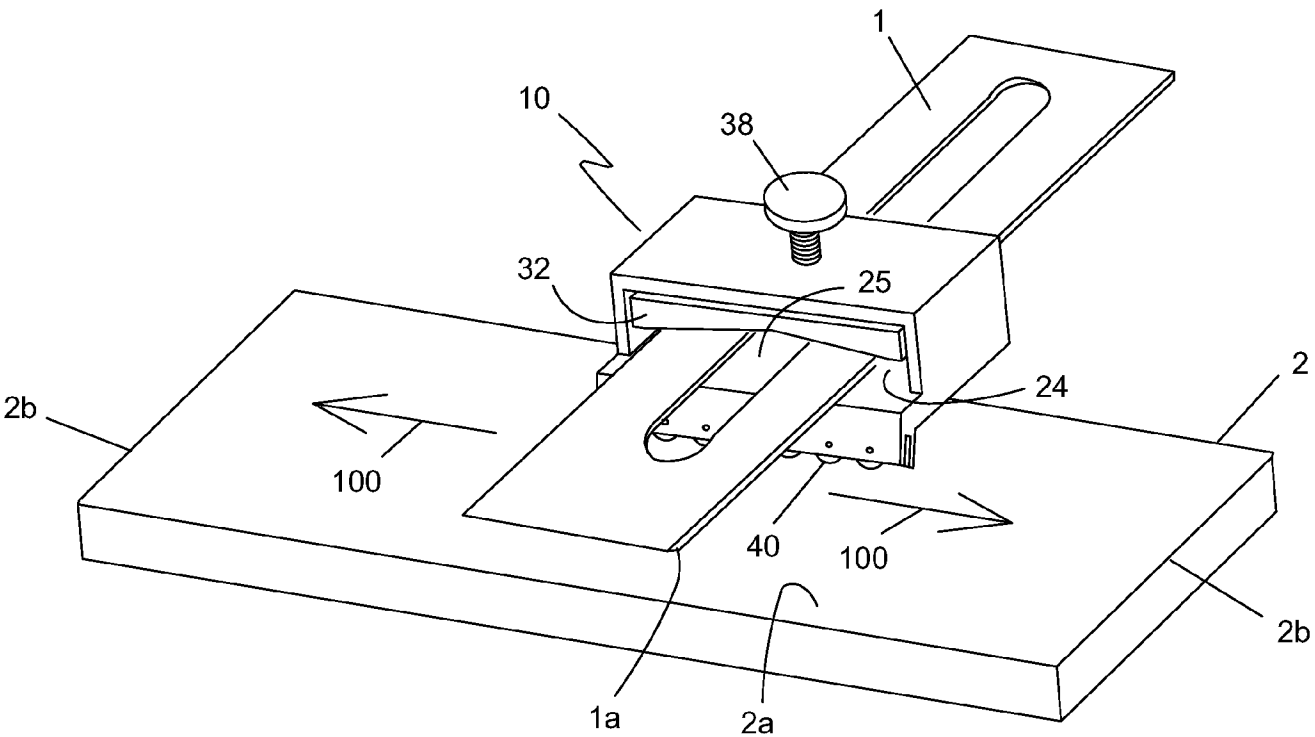
FIG. 7 is a perspective view of the embodiment of the present invention in FIG. 1 showing the positioning of the sharpening holder with a cutting edge on a honing surface.

FIG. 7 illustrates the use of the present invention with a planing blade 1 mounted in sharpening holder 10 on a honing surface 2*a* of a honing stone 2. Planing blade 1 is placed through opening 24 below fastening plate 32 so that blade 1 rests upon tool support surface 25 with the bevel cutting edge 1*a* facing towards the honing stone surface 2*a*. The blade 1 and sharpening holder 10 are adjusted so that cutting edge 1*a* contacts honing stone surface 2*a*. Fastener 38 is then turned to secure blade 1 in sharpening holder 10. Once secured, sharpening of blade 1 is accomplished by rolling the sharpening holder 10 with the cutting edge 1*a* on honing stone surface 2*a* in the directions indicated by arrows 100.

Unlike prior art hand or manual sharpening tools and jigs, the present invention moves the cutting edge 1*a* in a motion that is parallel to the cutting edge 1*a* and not perpendicular. The advantage of the sharpening holder 10 and its method of sharpening is that the entire honing stone surface 2*a* can be used. Cutting edge 1*a* can be moved to and beyond the edges 2*b* of honing stone 2 without sharpening holder falling off of honing stone 2. This motion and sharpening technique also eliminates the formation of a concavity in the honing stone surface 2*a*. In fact, it is typical that the honing stone surface 2*a* will develop a slight convex nature when tool sharpening is performed using a sharpening holder of the present invention, which is not detrimental to the cutting edge 1*a* or the useful life of the honing stone. In fact, this "parallel" sharpening technique lengthens the useful life of the honing stone compared to stones where a sharpening jig that relies on a "perpendicular" sharpening technique is used.

Figure 8:
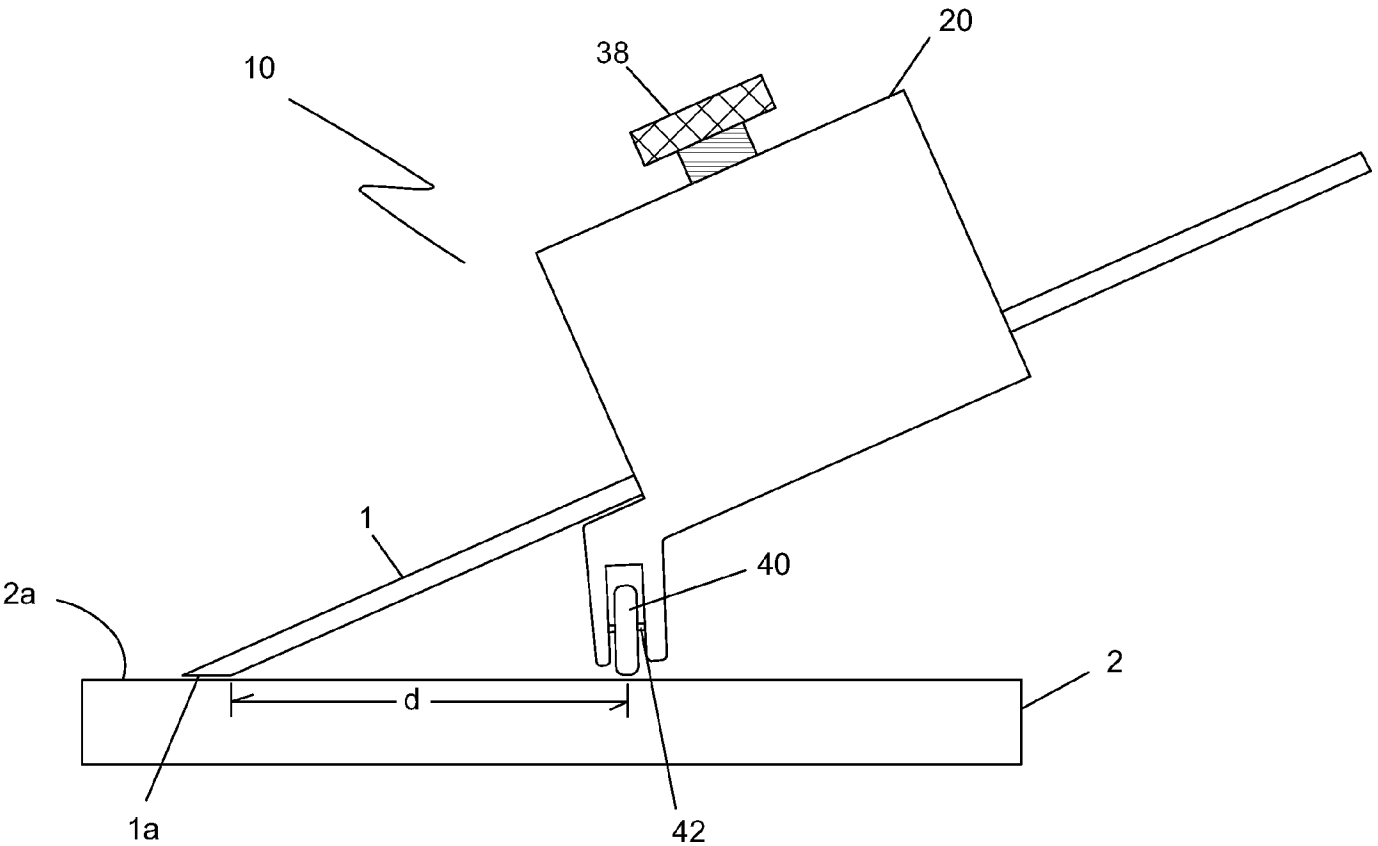
FIG. 8 is a side view of the embodiment of the present invention in FIG. 7 showing the positioning of the sharpening holder with a cutting edge on a honing surface.

Turning to FIG. 8, there is a side view of the embodiment in FIG. 7. Sharpening holder 10 is pivoted about the contact point of the roller members 40 with honing stone surface 2*a* so that cutting edge 1*a* makes contact with honing stone surface 2*a*. The distance between the cutting edge 1*a* and the plurality of roller members 40 depends on the bevel angle of the cutting edge 1*a*. The bevel angle is normally within a range between a knife blade and a scraper. The range is typically between about 21° (knife edge) and 32° (scraper). For wood planing blades, the bevel angle is about 27°.

As previously mentioned, sharpening holder 10 can be sized for the type of tool or blade that is to be sharpened as well as the size of the honing stone surface. The sharpening holder 10 is preferably structured so that the distance "d" illustrated in FIG. 8 between the plurality of roller members 40 and the cutting edge 1*a* is less that one-half of the honing stone width. This allows the entire surface of the honing stone 1 to be used for sharpening, which in turn allows the entire surface of the honing stone 1 to wear evenly and to avoid the wear concavity caused by prior art sharpening holders and jigs.

It is also noted that the distance the cutting edge 1*a* extends out of sharpening holder 10 can also change the pivoting angle of sharpening holder 10 along the contact points of the plurality of roller members with the honing stone surface 2*a*. This allows the sharpening holder 10 to be used to sharpen blades or tools with cutting edges that differ from one blade or tool to another. The allowed pivoting angle of sharpening holder 10 is directly related to the size of the plurality of roller members 40 as well as the distance the roller members 40 extend from sharpening body 20.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A sharpening holder for manually-sharpening a cutting edge to be honed over a honing surface, the holder comprising:

a body having a first end, a second end and an opening through the body between the first end and the second end, the opening having a tool support surface;

an adjustable clamping component having a fastening plate positioned within the opening wherein the fastening plate has a tool engaging surface to hold the tool against the tool support surface; and a plurality of roller members connected to a lower portion of the body below the opening and adjacent the second end wherein the plurality of roller members are aligned parallel to the longitudinal axis of the cutting edge to be sharpened and roll in a direction wherein the axis of rotation of the plurality of roller members is perpendicular to the longitudinal axis of the cutting edge to be sharpened.

2. The holder of claim 1 wherein the tool engaging surface has a recessed portion.

3. The holder of claim 2 wherein the tool engaging surface has a plurality of grooves.

4. The holder of claim 1 wherein the body includes a body extension that extends from the lower portion of the body below the opening and adjacent the second end and away from the body to which the plurality of roller members are mounted.

5. The holder of claim 4 wherein the body extension is angled to the lower portion of the body.

6. The holder of claim 5 wherein the angle is in the range of about 105° to about 125°.

7. The holder of claim 4 wherein the body extension includes a raceway to hold the plurality of roller members.

8. The holder of claim 1 wherein the plurality of roller members are selected from the group consisting of wheels, ball bearings, cylindrical rollers, and tapered rollers.

9. A method of manually-sharpening a cutting edge on a tool to be honed over a honing surface, the method comprising:

mounting the tool with a cuffing edge into a blade sharpening holder having a plurality of roller members mounted to a lower portion of the blade sharpening holder wherein the plurality of roller members are aligned parallel to the longitudinal axis of the cutting edge to be sharpened and have an axis of rotation perpendicular to the longitudinal axis of the cutting edge to be sharpened;

placing the plurality of roller members and the cutting edge of the tool onto a honing surface; and moving the blade sharpening holder along the honing surface causing the cutting edge of the tool to engage the honing surface wherein the plurality of roller members roll in a direction wherein the axis of rotation of the plurality of roller members is perpendicular to the longitudinal axis of the cutting edge to be sharpened.

10. The method of claim 9 further includes adjusting an angle of the blade sharpening holder to the honing surface.

11. The method of claim 9 further includes adjusting the extension of the tool out of the blade sharpening holder.

12. A method of making a blade sharpening holder for hand-sharpening of a cutting edge of a tool to be honed over a honing surface, the method comprising:

forming a holder body with a tool support surface between a first end and a second end;

mounting a plurality of roller members to the holder body along a lower portion of the body adjacent the second end wherein the plurality of roller members are aligned parallel to the second end and configured to roll in a direction wherein the axis of rotation of the plurality of roller members is perpendicular to the longitudinal axis of the cutting edge of the tool to be sharpened when the tool is mounted on the tool support surface of the holder body; and forming an adjustable fastening component having a fastening plate with a tool engaging surface sized for placement over the tool support surface to hold a tool having the cutting edge wherein the tool is against the tool support surface.

13. The method of claim 12 further comprising forming a recess in the tool engaging surface of the fastening plate.

14. The method of claim 13 further comprising forming a plurality of grooves in said tool engaging surface.

15. The method of claim 12 further comprising forming a raceway in the lower portion of the body for receiving the plurality of roller members.

16. The method of claim 12 further comprising forming a body extension that extends from the lower portion of the body below an opening and adjacent the second end and away from the body to which the plurality of roller members are mounted.

17. The method of claim 16 further comprising forming the body extension at an angle to the lower portion of the body wherein the angle is in the range of about 105° to about 125°.

18. The method of claim 16 further comprising forming a raceway in the body extension to hold the plurality of roller members.

19. The method of claim 12 further comprising selecting the plurality of roller members from the group consisting of wheels, ball bearings, cylindrical rollers, and tapered rollers for mounting along the lower portion.

* * * * *